US005502983A

United States Patent [19]

Dasher

[11] Patent Number: 5,502,983

[45] Date of Patent: Apr. 2, 1996

[54] APPARATUS AND METHOD OF FORMING A REFRIGERATOR CONDENSER

[75] Inventor: James F. Dasher, Center Township, Vanderburgh County, Ind.

[73] Assignee: Whirlpool Corporation, Benton Harbor, Mich.

[21] Appl. No.: 421,013

[22] Filed: Apr. 12, 1995

Related U.S. Application Data

[63] Continuation of Ser. No. 115,624, Sep. 3, 1993.

[51] Int. Cl.[6] ..... F25D 19/00

[52] U.S. Cl. ..... 62/454; 62/455; 62/507; 165/150; 165/171

[58] Field of Search ..... 62/454, 455, 507; 165/150, 171

[56] References Cited

U.S. PATENT DOCUMENTS

| | | | |
|---|---|---|---|
| 1,837,253 | 12/1931 | Collins et al. | 62/454 X |
| 1,886,498 | 11/1932 | Phelps | 165/171 X |
| 2,620,170 | 12/1952 | Brickman | 29/890.047 X |
| 2,646,259 | 7/1953 | Powell | 165/171 X |
| 2,687,625 | 8/1954 | Nadler | 165/171 X |
| 2,706,105 | 4/1955 | Young | 165/171 X |
| 2,772,077 | 11/1956 | Polad | 257/256 |
| 2,797,553 | 7/1957 | Baillif | 62/454 X |
| 3,071,937 | 1/1963 | Smith | 165/150 X |
| 3,162,023 | 12/1964 | Smith | 62/507 X |
| 3,388,562 | 6/1968 | Harle | 62/507 |
| 3,460,225 | 8/1969 | Beauvais | 29/890.07 |
| 3,785,168 | 1/1974 | Domingorene | 62/455 |
| 4,156,352 | 5/1979 | Gelbard et al. | 62/507 X |
| 4,186,945 | 2/1980 | Hahn | 285/19 |
| 4,490,990 | 1/1985 | Chastine et al. | 62/455 X |
| 4,490,991 | 1/1985 | Griffin | 62/279 |
| 4,735,062 | 4/1988 | Woolley et al. | 62/277 |
| 5,070,708 | 12/1991 | Malosh et al. | 62/295 |
| 5,097,897 | 3/1992 | Watanabe et al. | 165/171 X |
| 5,117,523 | 6/1992 | Jacobus et al. | 62/507 X |

OTHER PUBLICATIONS

Pp. 511 and 512, copied from "Fundamentals of Heat Transfer", Copyright 1981, published by John Wiley and Sons, Authors Frank P. Incropera and David P. Dewitt.

*Primary Examiner*—Christopher Kilner

*Attorney, Agent, or Firm*—Thomas J. Roth; Joel M. Van Winkle

[57] ABSTRACT

A condenser coil and a method of manufacturing thereof, with an extended heat transfer surface attached to a serpentine coil such that the assembly can be folded into a U-shape cross section to allow for cross flow of air through and around the condensing coil. In one embodiment, wires are attached to the serpentine coil in a preliminary stage of manufacture across a width of the coil along its length and the coil is wrapped into a U-shape. In a second embodiment, a planar flat plate is attached to a serpentine coil and the coil and flat plate are wrapped into a U-shape.

11 Claims, 3 Drawing Sheets

FIG. 3
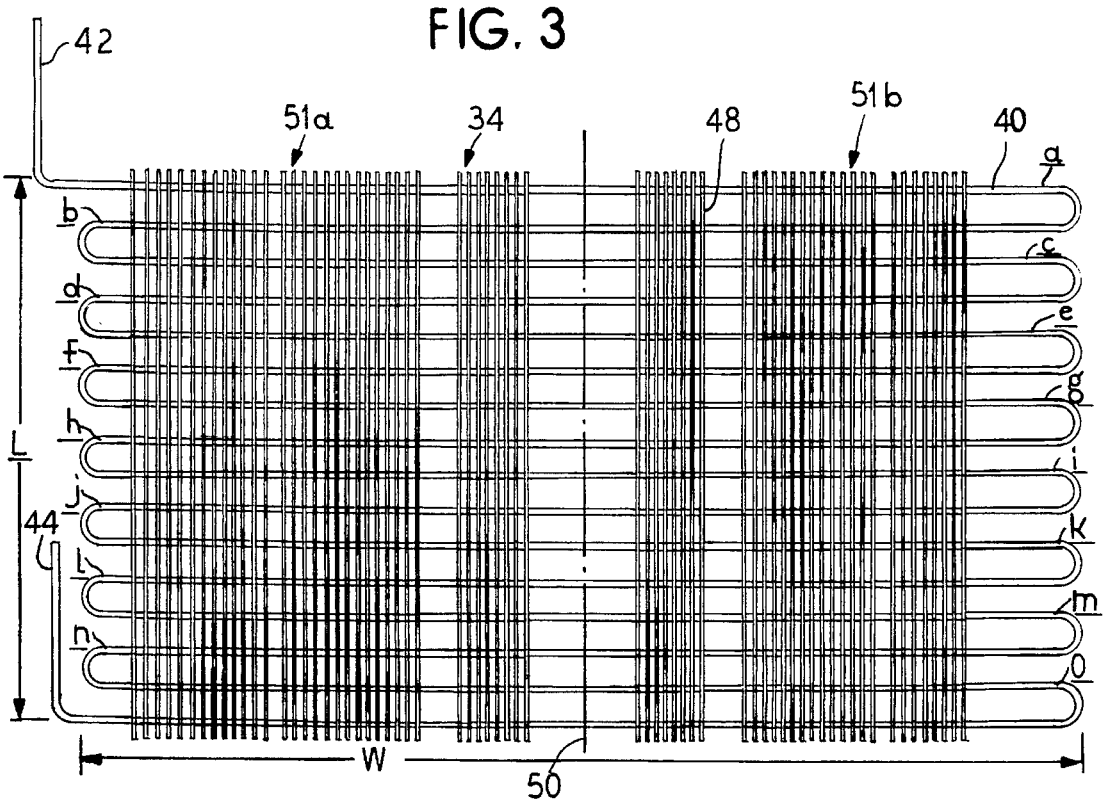
FIG. 5
FIG. 4
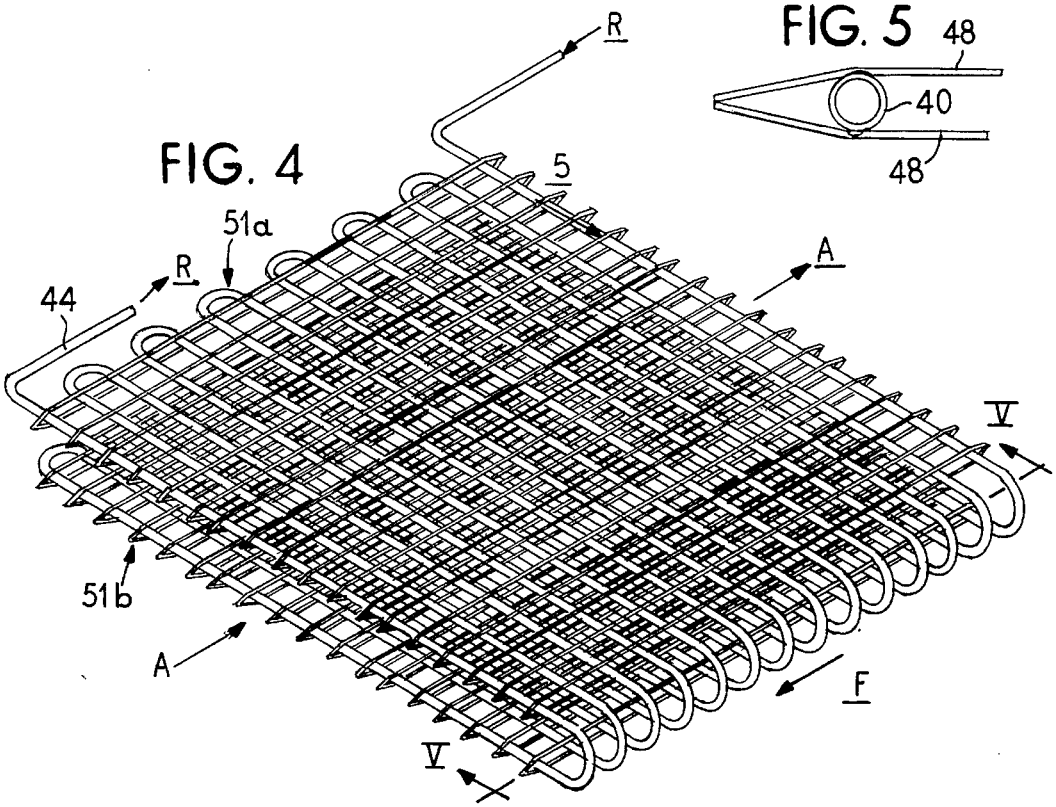

APPARATUS AND METHOD OF FORMING A REFRIGERATOR CONDENSER

This is a continuation of application Ser. No. 08/115,624, filed Sep. 3, 1993.

BACKGROUND OF THE INVENTION

The present invention relates to a heat exchanger, such as a condenser coil for a household refrigerator.

In particular, the present invention is a condenser tube structure, and a method for forming a condenser tube structure, for a refrigerator, the condenser tube structure having secondary heat transfer surfaces.

Tubular condensers having extended secondary heat transfer surfaces are generally known, such as U.S. Pat. No. 3,785,168, which discloses wires (21) attached to tubes (20). However, this coil represents a refrigerant progression which is counterflow to the air flow direction only in an upper tier and is same direction flow in a lower tier.

U.S. Pat. No. 2,359,926 discloses a tubular evaporator for a refrigeration unit which utilizes a metal sheet for the extended surfaces.

Manufacturing a wire and tube condenser requires a costly amount of factory floor space, material handling, equipment and labor.

The "wire field" is an area in the factory associated with the condenser fabrication process presently known. Each of the current condenser welders uses approximately 130 individual strands of wire fed into the welder. Each of these strands originates from a spool of wire that requires about four square feet of floor space in the factory. These spools of wire are located in the wire field. A high level of labor is required to stock the wire, tend the spools as wire is removed, weld the ends of one strand of wire to a new spool, and remove the empty spools.

It is not known to provide a heat exchanger, and method of manufacture thereof, for a refrigerator using a folded tube coil with wire fins or a plate extended heat exchange surface in accordance with the present invention.

SUMMARY OF THE INVENTION

It is an object of the invention to provide a condenser coil with an extended surface which provides effective heat transfer and air flow characteristics and which realizes a manufacturing cost advantage. Additionally, a reduced deck height of the condenser while maintaining sufficient surface area is advantageous.

It is also an object of the invention to reduce the factory lay-out area associated with manufacturing the condenser coil.

It is advantageous to maintain the refrigerant flow counter to the air flow in a forced air high side refrigerant system which yields a desirable improvement in lowering condensing temperatures.

The object is inventively achieved in that in a first embodiment a serpentine condenser coil is attached to a planar metal sheet and the metal sheet with the coil is bent into a U-shape. The deck height of the thus formed condenser can be lowered to 2½ inches to increase air velocity over the condenser.

The machinery required to produce this first embodiment can be smaller than that required for a wire field condenser and is, for example, simpler and less costly than a condenser wire welder.

The condenser can be cleaned from the front of the refrigerator by removing the grill thereto. Also, ducting of air around and through the condenser to achieve performance improvement can be readily achieved due to the solid surface of the condenser and its shape.

Another advantage of the metal plate concept described above is at the least a manufacturing one, the floor space requirements are less than that of the wire field as only an uncoiler for the sheet stock is required.

The folded U-shape metal sheet and coil allows for an effective counter flow between air and refrigerant in both an upper and lower tier of the coil, i.e., along the entire length of the coil, to improve lowering of condensing temperatures.

In a second embodiment, a serpentine condenser coil field has wire rods welded thereto in a perpendicular crossing pattern incrementally spaced along a length of the coil. The condenser coil with the attached wire rods is then folded over into a U-shape. The resultant heat exchanger can be cooled by a counter current of air through and around the U-shaped cross section of the coil. In this arrangement, the wires themselves are not bent, the tubes are bent to form a two deck U-shaped arrangement.

BRIEF DESCRIPTION OF THE DRAWINGS

FIG. 3 is a plan view of a condenser coil in a preliminary stage of manufacture;

FIG. 4 is a perspective view of the condenser coil of FIG. 3 in a secondary stage of manufacture;

FIG. 5 is a partial sectional view taken generally along line V—V of FIG. 4;

DETAILED DESCRIPTION OF THE PREFERRED EMBODIMENTS

Figure 1:
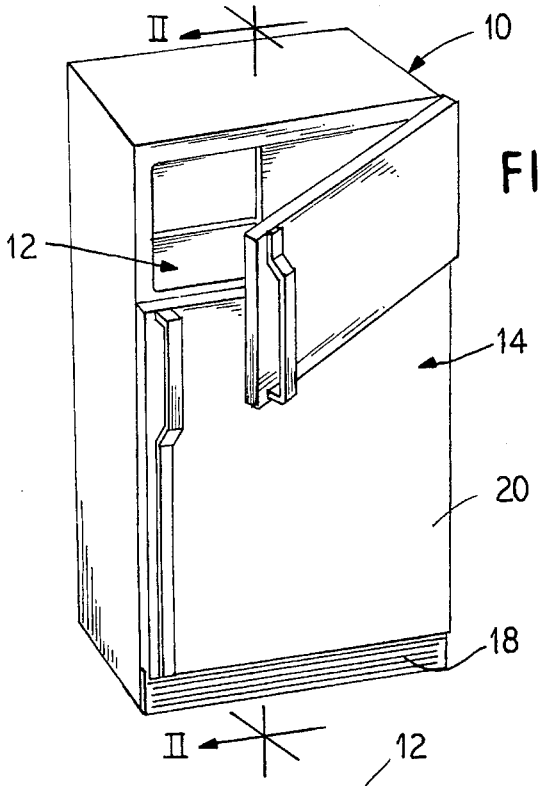
FIG. 1 is a perspective view of a refrigerator of the present invention.

FIG. 1 shows a refrigerator 10 having a freezer compartment 12 and a refrigerator compartment 14. A front air grille 18 is mounted below a door 20 of the refrigerator compartment 14.

Figure 2:
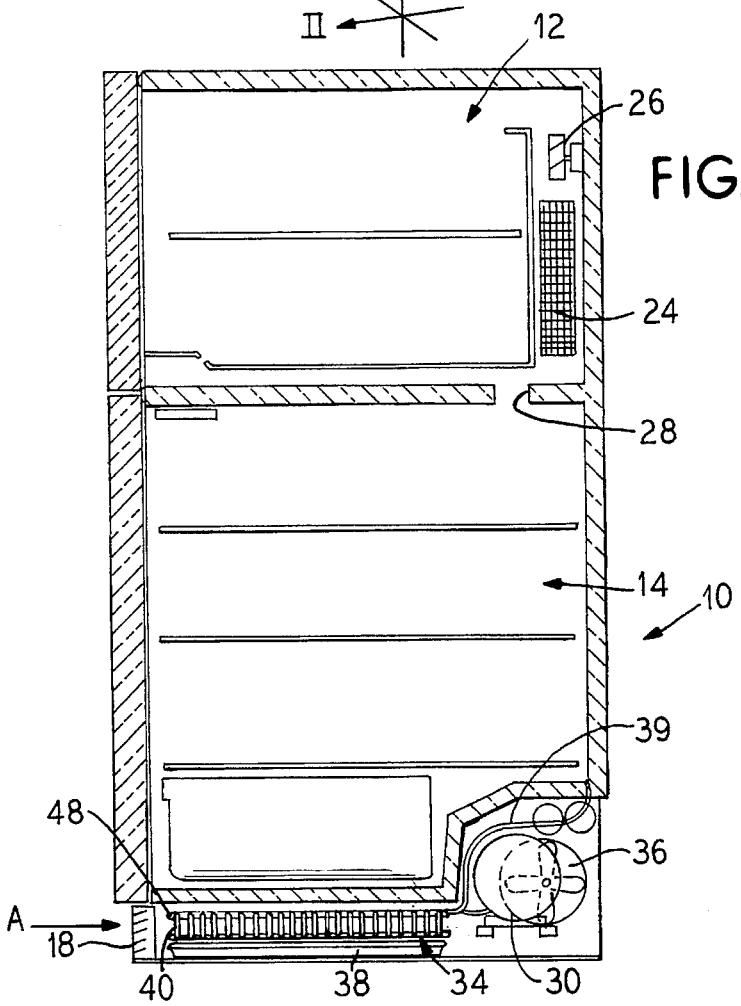
FIG. 2 is a sectional view taken generally along II—II from FIG. 1, with the refrigerator compartment door closed.

FIG. 2 shows a mechanical refrigeration system of the refrigerator 10 in more detail. An evaporator 24 is mounted in the freezer compartment 12. A circulating fan 26 maintains an air flow within the freezer compartment 12 across the evaporator 24. The circulation fan 26 circulates cold air from the freezer compartment 12 and directs the air through a vent 28 into the refrigeration compartment 14. Below the refrigeration compartment 14 resides a compressor 30, a condensing coil 34 and an air fan 36, and a drip pan 38. The evaporator 24, the compressor 30 and the condenser 34 are flow connected with refrigerant tubes 39 as is known in prior art refrigeration systems. The fan 36 draws air A through the front grille 18 across and through the condensing coil 34 over the compressor 30 and expels it from the refrigerator 10.

FIG. 3 shows one embodiment of the condensing coil 34 in a preliminary stage of manufacture. The condensing coil 34 is constructed of a serpentine cooling coil 40 having an inlet 42 and an outlet 44 and a length indicated as L and a width indicated as W. Arranged extending lengthwise across the tubular coil 40 are wires 48 which are attached to a top and bottom surface of the tube coil 40. The wires are welded to the individual tubes as shown in FIG. 5.

As shown in FIG. 4, after the wires are attached to the tube 40, the condenser coil 34 is folded at approximately its half width line 50 into a U-shape. Two overlying tiers of tubes 51*a*, 51*b* are formed by the folding. Once installed into the refrigerator, the air flow A is perpendicular to the direction of flow S of refrigerant within the tube 40. The tube 40 is thus formed into alternating back and forth passes between tiers, shown in FIG. 3 as a through o. The progression of refrigerant in the tube 40 is in a direction E, which is counter to the air flow A. This results in lower condenser temperatures.

The wires 48 provide an extended surface area for heat transfer through the wall of the tubes 40. As shown in FIG. 4, the wires themselves need not be bent into the U-shape because they run across the tubular coil.

Figure 6:
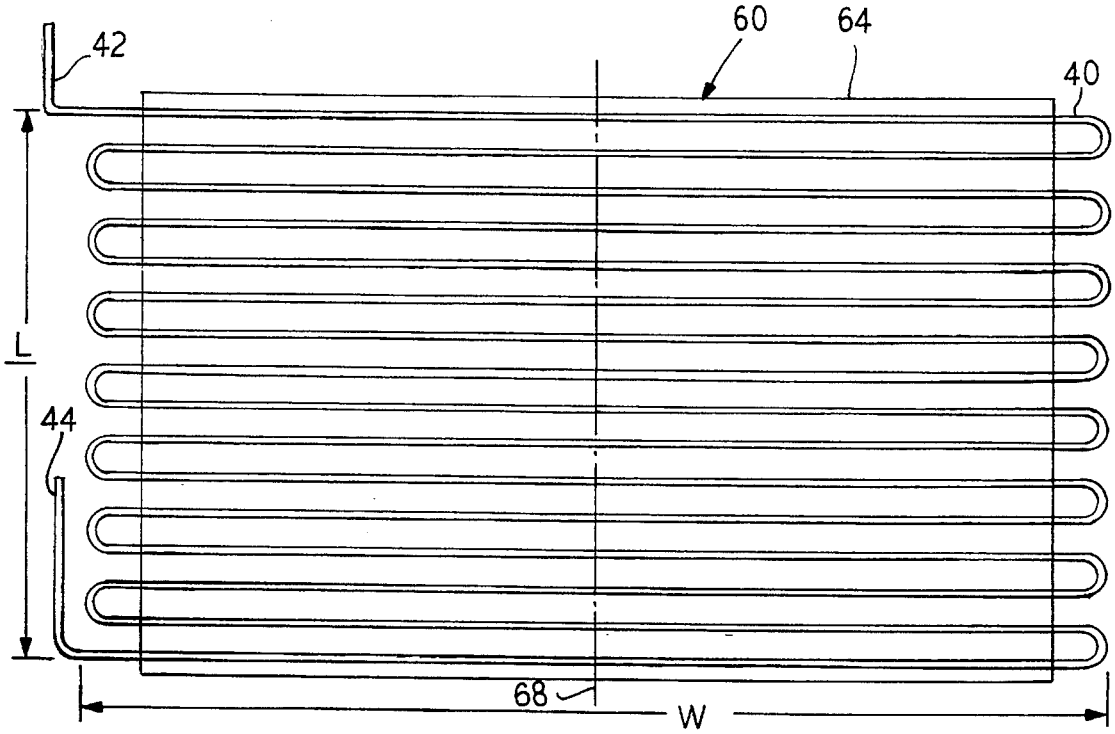
FIG. 6 is a plan view of an alternate embodiment of a condenser coil in a preliminary stage of manufacture.
Figure 7:
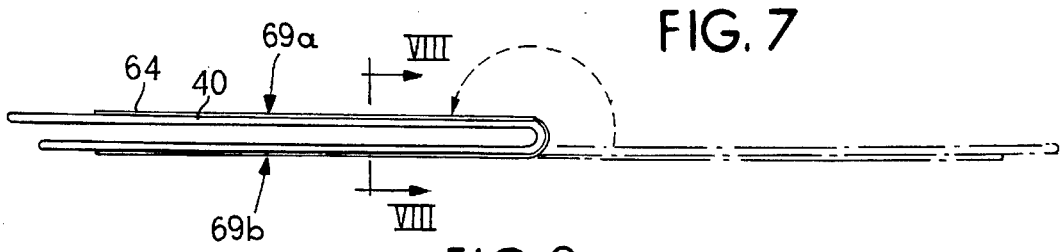
FIG. 7 is an elevational view of the condenser coil of FIG. 6 in a secondary stage of manufacture.
Figure 8:
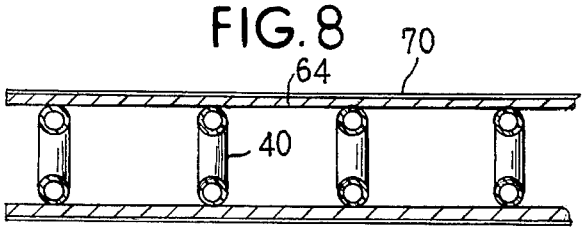
FIG. 8 is a sectional view taken generally along line VIII—VIII of Figure.

FIG. 6 shows another embodiment of the condenser coil, a condenser coil 60. In this view, the coil 60 is in a preliminary stage of manufacture. The coil 60 contains a serpentine tube 40 upon which is welded or otherwise attached, a plate 64, such as a steel plate. The coil 60 has a width indicated as W and a length indicated as L As shown in FIG. 7, the coil 60 is then folded about its half width line 68 to form a U-shape cross section. Two tiers of tubes 69*a*, 69*b* are thus formed. FIG. 8 shows the sectional construction wherein the tube 40 is attached to the plate 64 and a corrosion-resistant coating 70 is applied onto the plate.

The plate 64 can thus form an outside surface as shown or can form an inside surface by opposite folding.

Air flow through this embodiment is the same as the first embodiment, perpendicular to flow of refrigerant in the tube and opposite to progression of refrigerant through the coil 60.

As shown in FIG. 4 and FIG. 7 respectively, the overlying tiers 51*a*, 51*b* and the tiers 69*a*, 69*b* are relatively closely spaced together compared to the widths of the tiers. That is, the resulting width of each tier is greater than the spacing between adjacent tiers. This allows for a low profile compact design having sufficient heat exchange surface area.

Although the preferred embodiment illustrated shows only two tiers made by a single fold, additional tiers could be provided by increasing the number of folds.

As is apparent from the foregoing specification, the invention is susceptible of being embodied with various alternation and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention is which an exclusive property or privilege is claimed are defined as follows:

1. A refrigerator having a refrigeration compartment to be cooled and a refrigeration system, said refrigeration system comprising:

an evaporator arranged in heat transfer with objects in said refrigeration compartment;

a compressor;

a condenser coil being disposed below said refrigeration compartment, said condenser coil further comprising:

a serpentine tube having a plurality of U-shaped tube passes, each pass having two substantially straight tube sections joined by a U-shaped bend section, said straight tube sections oriented across a width of said serpentine tube, wherein fluid flow inside said serpentine tube makes alternate back and forth passes in a direction along said width of said serpentine tube, progressing along a length of said serpentine tube, and an extended heat transfer surface arranged connected to said straight tube sections across said length of said serpentine tube; and tubing means for fluidly interconnecting said evaporator, compressor and condenser coil; and an air transport means for moving air over said serpentine tube in a direction perpendicular to said tube passes and counter to the progression of said fluid along said length of said serpentine tube.

2. The refrigeration system according to claim 1, wherein said extending heat transfer surface comprises a plurality of wires wrapped around a length of said serpentine tube.

3. The refrigeration system according to claim 1, wherein said extending heat transfer surface comprises a flat plate attached to said U-shaped tube passes.

4. The refrigeration system according to claim 1, wherein said serpentine tube further comprises:

two tiers formed by folding said U-shaped tube passes along a lengthwise line, wherein said flow inside said tube makes alternate back and forth passes between tiers along said width of said serpentine tube.

5. The refrigerator system according to claim 4, wherein said two tiers are formed by folding said U-shaped passes at substantially a mid-point of each tube pass width.

6. The refrigeration system according to claim 4 wherein said extended heat transfer surface is arranged connected to each tier but is not present at said fold in said U-shaped tube passes.

7. The refrigeration system according to claim 1, wherein said extending heat transfer surface comprises a plurality of elongate wires welded lengthwise across said coiled tube at increments along the width of each of said straight tube sections.

8. A refrigerator comprising:

a refrigeration compartment for holding objects;

a compressor;

an evaporator arranged in heat transfer with objects in said refrigeration compartment;

a condenser coil;

an equipment compartment disposed below said refrigeration compartment, said compressor and said condenser coil being disposed in said equipment compartment;

tubing means for fluidly interconnecting said evaporator, compressor and condenser coil such that said compressor moves refrigerant through said condenser and said evaporator;

wherein said condenser coil comprises:

a serpentine tube formed of substantially parallel runs of tubing, each adjacent pair of runs interconnected by a bend, said serpentine tube having a width extending between opposite bends, said serpentine tube being folded between said opposite bends to form two overlying tiers of tubing runs, said tubing runs having a folded width greater than a distance between adjacent overlying tiers, said serpentine tube having a length perpendicular to said width, wherein refrigerant flow inside said serpentine tube makes alternate back and forth passes in a direction along said width of said serpentine tube, progressing along said length of said serpentine tube, said condenser coil being disposed within said equipment compartment such that said two tiers extend beneath said refrigerator compartment, said compressor moving refrigerant through said condenser coil such that the progression of refrigerant is toward the front of said equipment compartment, and an extended heat transfer surface arranged connected to said tiers and spanning across said length of said serpentine tube; and a fan disposed in said equipment compartment for drawing air from the front of said refrigerator over said condenser such that air flow over said condenser coil is counter to the progression of said refrigerant in said condenser.

9. The refrigerator according to claim 8, wherein said extending heat transfer surface comprises a plurality of wires wrapped around a length of each of said tiers incrementally along said width of said serpentine tube.

10. The refrigeration system according to claim 8, wherein said extending heat transfer surface comprises a U-shaped plate attached to each of said two tiers.

11. The refrigerator according to claim 8, wherein said serpentine shape is folded at approximately a half width of said serpentine shape and said overlying tiers have equal widths.

* * * * *